United States Patent [19]

Robben et al.

[11] 4,310,952

[45] Jan. 19, 1982

[54] BUCKLE WITH READILY RELEASABLE LATCH

[75] Inventors: Paul J. Robben, Hasselt; Hugo R. De Vuyst, Wetteren, both of Belgium

[73] Assignee: N. V. Klippan S.A., Haasrode, Belgium

[21] Appl. No.: 966,414

[22] Filed: Dec. 4, 1978

[30] Foreign Application Priority Data

Dec. 7, 1977 [DE] Fed. Rep. of Germany ..... 2754389
Oct. 16, 1978 [DE] Fed. Rep. of Germany ..... 2844977

[51] Int. Cl.[3] ..... A44B 11/25
[52] U.S. Cl. ..... 24/230 A
[58] Field of Search ..... 24/230 A, 230 BC, 230 AK, 24/230 R

[56] References Cited

U.S. PATENT DOCUMENTS

| | | | |
|---|---|---|---|
| 3,895,196 | 7/1975 | Lewis | 24/230 A |
| 4,004,115 | 1/1977 | Esner | 24/230 A |
| 4,096,606 | 6/1978 | Stephenson | 24/230 A |
| 4,182,008 | 1/1980 | Pouget | 24/230 A |

*Primary Examiner*—Roy D. Frazier
*Assistant Examiner*—Alexander Grosz
*Attorney, Agent, or Firm*—Roger H. Criss

[57] ABSTRACT

A safety belt buckle including a latch for engagement with an opening in a tongue, an ejection spring for the tongue and a bias spring for a push button that can be brought into engagement with the latch, wherein the latch can pivot on an axis approximately perpendicular to the direction of insertion of the tongue, the latch being biased in the unlocked position by the force of the bias spring, and when the bias spring is at least partially extended, the latch is maintained in locking engagement with the tongue by a reinforcing member that moves together with the push button.

16 Claims, 3 Drawing Figures

BUCKLE WITH READILY RELEASABLE LATCH

BACKGROUND OF THE INVENTION

The invention relates to a buckle, particularly for a safety belt in an automotive vehicle, comprising a casing attached by means of a fastening arrangement to an anchoring point on the vehicle, a latch that can be brought into locking engagement with an opening in a tongue, an ejector spring for the tongue and a bias spring for a push button that can be brought into engagement with said latch.

Numerous designs for buckles of safety belts for automotive vehicles are known. Many buckles have the aforecited characteristics and are constructed so that the latch is biased in the locked or engaged position. Until now, it has always been thought that this provision enhances the reliability of the locking engagement.

It is also important, however, to consider the emergency case in which the release of the tongue from the buckle must occur instantly and smoothly. Moreover, one must keep in mind the normal functions of the buckle and particularly, in normal use, the possibility of smoothly removing the tongue by pressing a push or press button.

The object of the invention is to improve a buckle of the aforecited type so that when, in the normal position, the push button is not depressed, the locking engagement with the tongue is absolutely reliable and yet the unbuckling is substantially facilitated compared to conventionally designed buckles. In other words, when in known buckles, in the normal position with the push button not depressed, the latch was in locked engagement, unbuckling until now was difficult. In known buckles, until now depressing the push or press button did not necessarily ensure smooth movement of the latch out of the opening of the tongue which would result in instantaneous release of the safety belt system. Moreover, until now there has also existed the difficulty that after apparent locking it was possible, under a certain load, to pull the tongue from the buckle even without pressing the push button.

According to the invention these drawbacks are eliminated by providing a latch which is pivotable on a pivotal axis perpendicular to the direction of insertion of the tongue and is fixed in the casing and which is biased in the unlocked position by the bias spring, said latch, when the bias spring is at least partly extended, being held in locked engagement with the tongue by a reinforcing member that moves together with the push button. A novel and surprising feature of the buckle of the invention is the fact that, in the open position, the latch is in a stable position because the button return spring at the same time also exerts pressure, in the release direction, on the latch that is pivotable on a pivotal axis. This ensures that, after actuating the push button and unbuckling, the buckle will remain in the open, i.e., disengaged or unlocked position. The buckle of the invention saves one the effort which in conventional buckles is needed to move the latch from its normally closed position into the open position so that the tongue can be inserted into the buckle. By contrast, the buckle of the invention is normally in the open, receiving position and, by insertion of the tongue, is readily brought into the engaged position.

According to the invention, it is also advantageous that the supporting end of the latch, disposed near the reinforcing member, is provided on the inside of the push button and, when the push button is depressed, can be moved into an internal downwardly opening cavity. Another advantage of the invention lies in the fact that the reinforcing member is shaped in the form of a crossbar fastened to the underside of the push button, the longitudinal direction of said member being parallel to the pivotal axis of the latch. This reinforcing member, which in a preferred embodiment has the form of a crossbar, for example a square bar, is freely movable relative to the latch, and, similarly, the push button is freely movable back and forth over some distance, relative to said supporting end of the latch, in the direction of insertion of the tongue. In other words, this reinforcing member bearing the supporting end of the latch is preferably held by the push button so that it moves therewith. The surprising advantage of the invention is that only in a certain position, namely when the button return spring is in the extended position or, in other words, when the push button is in the normal position of rest, can the supporting end reach the supporting position opposite the reinforcing member and press the latch into locking engagement holding it there. In other words, said reinforcing member in the push button holds the latch in locking engagement safely and reliably against the torque generated by the bias spring and which tends to pivot the latch into the unlocked position. When, by actuating the push button, the reinforcing member is moved out of the cited certain position for a distance such that the supporting end of the latch is essentially completely pushed down and away from the reinforcing member, the supporting end can move into the downwardly opening internal cavity of the push button without encountering any resistance; in other words, the latch then pivots on the pivotal axis and into the unlocked or release position.

According to the invention, it is also advantageous that the other end of the latch which is opposite the supporting end is provided with an opening intended to receive a guide pin for the push button, said pin guiding the push button and the bias spring which abuts against the other end of the latch. In this manner, not only is the bias spring guided in the correct direction, but at the same time the push button is also guided in the direction in which it moves, without the need for special extra parts which would add to the cost of the buckle.

Another useful embodiment of the invention is characterized by the fact that the pivotal axis of the latch is located near the other end, i.e., the end containing the opening, forming a long and a short lever arm. In this manner, it is possible to adjust the length of the lever arms depending on the forces desired. By the aforecited provisions, the force required to pivot the latch into locking engagement when the tongue is inserted into the buckle is kept conveniently small. In other words, in fastening the belt, the car occupant feels only an insignificant resistance and yet the forces acting when the latch is pivoted back into the release position are sufficient so that when the push button is actuated, i.e., when the reinforcing member is moved relative to the supporting end, the latch is immediately pivoted into the unlocked position.

In another advantageous embodiment of the invention, the latch has an elongated shape extending over from about one-half to three-quarters of the length of the buckle casing, and when viewed in longitudinal section has the shape of a rocker with upturned U-shaped ends. This design was found to be particularly reliable. A latch thus shaped can be used at the same time for locking as well as to provide the guide hole for the push button pin and as a stop for the button return spring.

It is also advantageous, according to the invention, that a holding arm protrudes from the underside of the latch for a distance equal to the thickness of the tongue at a point such that in the locked position said holding arm lies exactly in the opening of the tongue. A latch of this design is technically simple and economical to produce without affecting the forces generated by the latch in a simplified buckle.

As a result of the provisions of the invention, the latch cannot pivot when the reinforcing member, preferably in the form of a crossbar, is arranged above the supporting end of the latch. This reinforcing member moves together with the push button and is preferably located in an opening of rectangular cross-section in the push button base.

After the tongue has been inserted, i.e., after the car occupant has fastened the belt, the belt can be unbuckled by actuating the push button thereby moving the reinforcing member in relation to the supporting end of the latch. In this manner the latch pivots, releases the tongue and remains in the open position. This pivoting motion is imparted by the tongue which is ejected by the ejector spring. Tension on the belt strap can possibly also pull the tongue out thus causing the latch to pivot into the open position. This swiveling motion toward the open position is also favored by the partial extension of the bias spring which causes the latch to pivot.

The push button and the reinforcing member remain in this advanced position when the buckle is opened. The latch is kept in the open position by the button return spring which functions between the push button and the other end of the latch. When the tongue is taken out of the buckle, the latch is also supported by the ejector spring.

Reinserting the tongue into the buckle by pressing the small front edge against a sliding hook generates a reverse torque about the pivotal axis of the latch which pivots said latch back into the closed position. This brings the holding arm in locking engagement with the opening in the tongue. The reinforcing member and the push button can now return to their starting position, the contact between the supporting end of the latch and the reinforcing member once again keeping the latch from pivoting.

Additional advantages, features and applications of the present invention will become apparent from the following description together with the figures which show:

Figure 1:
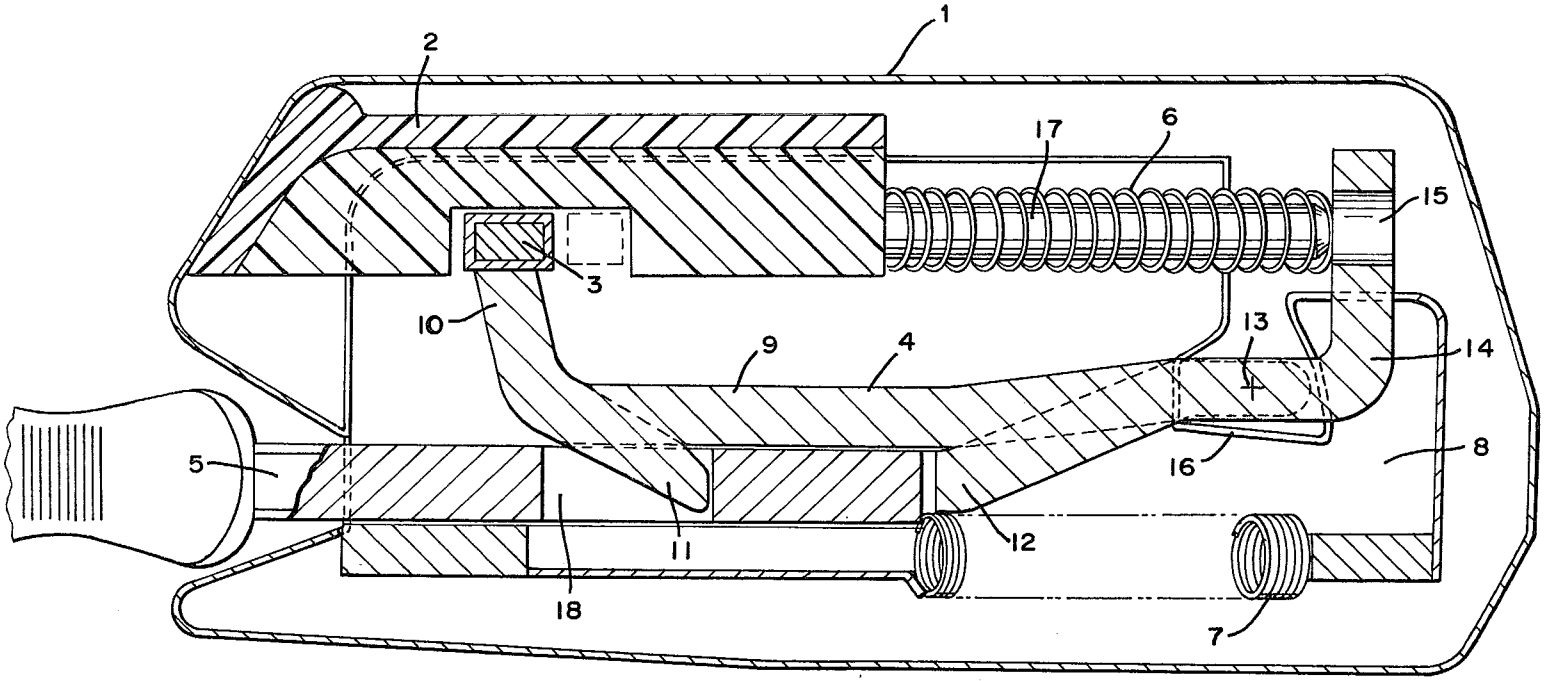
FIG. 1 depicts schematically a longitudinal section through a buckle according to the invention in the locked position.

With reference to FIG. 1, elongated casing 1, which by means of a fastening arrangement not shown in the drawing is attached to the vehicle at any given anchoring point, contains push button 2 with reinforcing member 3 shaped in the form of a crossbar, latch 4, tongue 5, bias spring 6 for button 2 and ejector spring 7 acting as compression spring at the bottom of base 8.

The latch, generally indicated by reference numeral 4, has a long lever arm 9 with an upturned support end 10 and a downturned holding arm 11 and, on the other side, striking arm or latch hook 12; also, on the other side of pivotal axis 13, said latch has a short lever arm 14 containing an opening 15. The short lever arm 14 is also upturned so that when viewed in longitudinal section the overall shape of the latch 4 is that of a rocker with U-shaped, upturned ends 10 and 14.

Pivotal axis 13 is formed by a recess 16 made in the base 8, as shown in the drawing. Opening 15 consisting of a borehole accommodates pin 17 which is attached to button 2 and extends longitudinally back from it in the direction in which said push button moves, and into the inside of casing 1. Bias spring 6 for button 2, on the other hand, is disposed externally on the edge of opening 15 and is held by said edge on this side and by the back face of button 2 on the opposite side.

Holding arm 11 of latch 4 extends into opening 18 of tongue 5 and when tongue 5 is pulled out and crossbar 3 is not in the position indicated in the drawing by solid lines, said arm acts as an unlatch hook causing latch 4 to pivot clockwise on its pivotal axis 13 as shown in the drawing. This can be achieved only by pushing button 2 to the right in the drawing to cause reinforcing members 3 to assume the position indicated by the broken lines. As described above, this is achieved by the fact that reinforcing member 3 is supported in, or fastened to, a rectangular opening at the bottom of push button 2 thus making it move together with said button.

In practice, the buckle of the invention functions as follows: When the car occupant wants to leave the vehicle, i.e., to unbuckle the belt or pull tongue 5 out of the buckle, said occupant must, in order to release the buckle from the locked position as shown in the drawing, push button 2 to the right until reinforcing member 3 is in the position indicated by the broken lines. Button return spring 6 is thereby compressed, and push button pin 17 passes through opening 15 in the other end 14 of latch 4. The force of ejector spring 7 acting on the narrow front edge of tongue 5 in the direction of ejection and possibly the tension on the belt strap to release tongue 5 exert a force on holding arm 11 which causes said arm to act as an unlatch hook. This is because said arm together with the torque of the small lever arm 14 is capable of causing latch 4 to pivot on pivotal axis 13 in clockwise direction thus forcing supporting end 10 to enter the downwardly opening internal cavity of button 2. At the same time, however, holding arm 11 moves out of opening 18 of tongue 5 making it possible to pull said tongue out of the buckle.

The buckling of the belt involves the reverse sequence of movements: tongue 5 which in the drawing of FIG. 1 is inserted from left to right compresses ejector spring 7 and at the same time, through contact with latch hook 12, pushes latch 4 into the position shown in the drawing. Holding arm 11 thereby again ends up in opening 18 of tongue 5 performing its latching or locking function. Because supporting end 10 of latch 4 has swung out of the way of reinforcing member 3, bias spring 6 can now push button 2 back into the position shown. Supporting end 10 now makes contact with reinforcing member 3 so that the latch can no longer pivot. Push button pin 17 and button return spring 6 have, of course, moved back into the position shown in the drawing.

In another embodiment of the invention, the abutment part is formed as a crossbar inserted at least at one end in the underside of the sliding button, the longitudinal direction of which crossbar is parallel to the pivot axis of the latch.

In one mode of execution the push button can have two small recesses (e.g., numeral 24 in FIG. 2) at a certain distance from each other, in the direction across from the direction of locking tongue insertion, which restrain the crossbar. Thereby both frontal surfaces of the recess in question are relatively close to the corresponding frontal surfaces of the crossbar. The crossbar is inserted with very little play into the recess in the underside of the sliding button, both in forward and reverse directions. In other words, in this mode of execution the crossbar is displaced according to the motion of the sliding button.

In another advantageous form of execution of the invention, which is characterized by the fact that the crossbar (under tension of a supporting spring) is in contact with one frontal side of one of the recesses in the sliding button, the movement of the crossbar is conducted in a controlled manner only in one direction, preferably and especially in the direction of disengaging or opening of the locking buckle when the sliding button is pushed in. In this form of execution of the sliding button, the sliding button can be returned in the other direction to the original rest position under the effect of the extending tensioning spring, without necessarily moving with it the crossbar, controlled by the recess. Since, however, the crossbar should also move forward at the forward movement of the sliding button for perfect function, the invention provides the supporting spring, which pushes the crossbar on the frontal side of the recess across from the spring.

Figure 3:
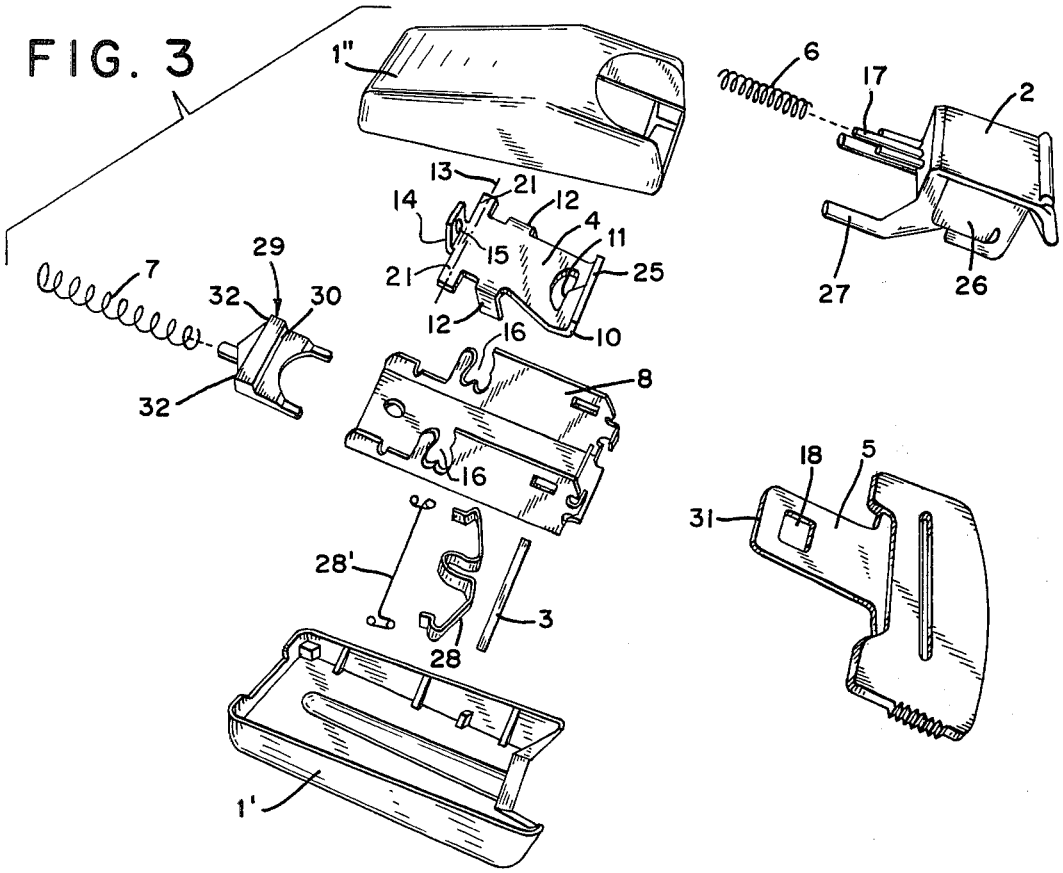
FIG. 3 is an exploded view of a third embodiment of the buckle of the invention.

Various forms of executions have been found especially useful, in which the supporting spring can be a spiral spring, a torsional spring, or a leaf spring (e.g. numerals 28 and 28' in FIG. 3).

In a further improved version of the invention, the ejector spring includes a support part 29 at the end abutting on the locking tongue, the front surface 30 of which (adjusted towards the opening which accepts the locking tongue) is in contact with the locking tongue and the back shoulder of which is in contact with the ejector arm of the latch. This support part allows better control of the ejector spring, especially better guidance of its force in the direction of the effect, so that on one side the pivoting movement of the latch is smoothly assured, and on the other side the force used by the ejector spring is optimally concentrated on the forward edge of the locking tongue.

Furthermore, according to the invention it is advantageous to form the ejector arm from a bent wing projecting from the latch in a direction perpendicular to the insertion direction of the locking tongue. In other forms of execution it can be easily visualized, that the ejector arm is formed of two or more separate wings arranged at a distance from each other, which are formed from the central surface of the latch by stamping and bending. However, the sideways control is further improved if the ejector arm is formed in the described manner in one or two side wings.

Furthermore, it is advantageous for the lengthwise guidance of the latch and the crossbar, if, in accordance with this invention, the sliding button has side walls protruding to the base of the buckle on both sides along its direction of motion, in the range of the pivot axle of the latch.

Preferably, the side walls keep the latch from displacement in the direction perpendicular to the insertion direction of the locking tongue by the fact that the arms or wings on the pivot axle of the latch rest against the side walls.

As a further practical improvement of the invention, the restraining arm of the latch is formed from a wing stamped and bent out of the center surface of the latch. According to the shape of the locking tongue, the restraining arm is shaped to fit. If in some forms of execution the locking tongue exhibits a recess, the restraining arm can be formed from a bent wing in the above described manner. However, there are also locking tongues, which have at the front two indentations on the side edge at a distance from each other. In such a case, two restraining arms or two wings stamped and bent out of the central surface of the latch, are provided.

Figure 2:
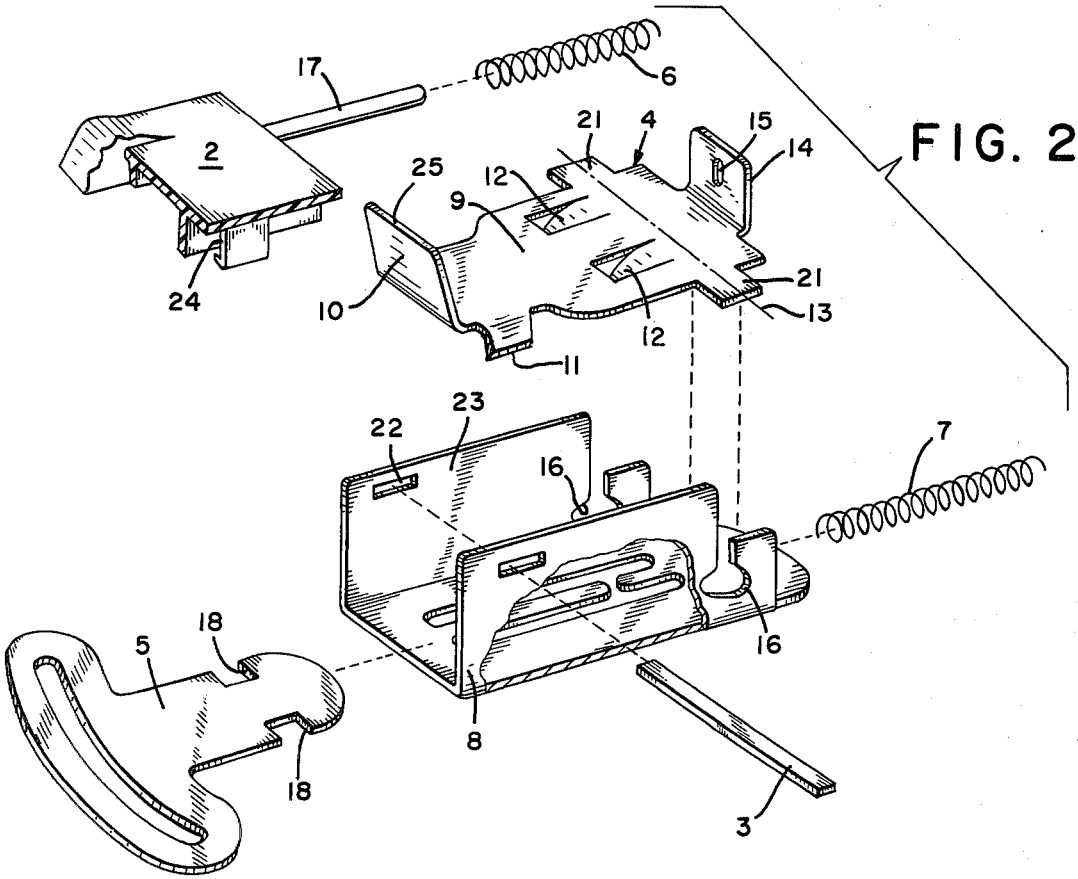
FIG. 2 is an exploded view of a second embodiment of the buckle of the invention.
Figure 4:
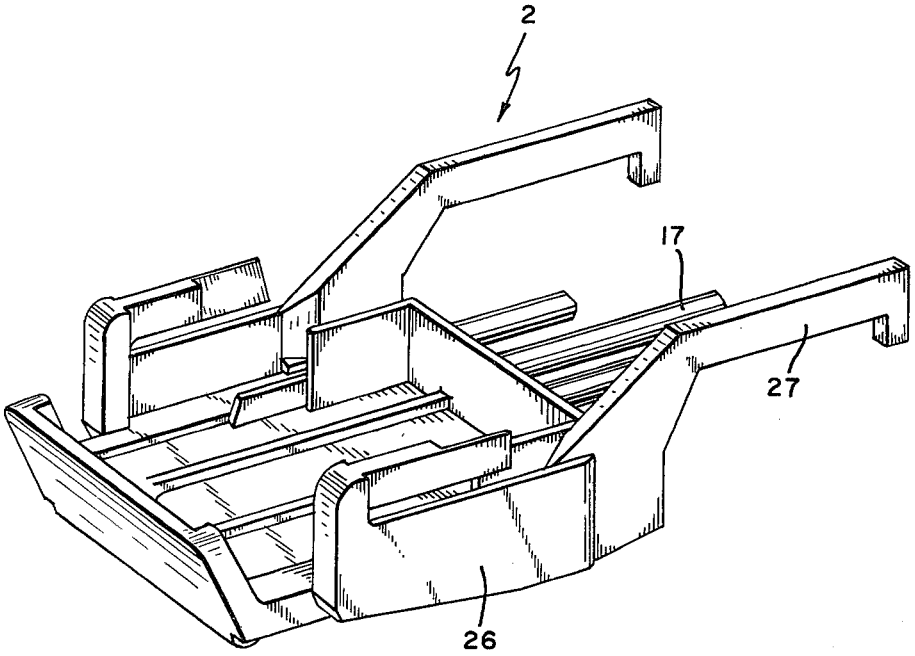
FIG. 4 is a view of the release button of FIG. 3 shown upside down.

For simplicity's sake, in FIG. 2 the housing is not shown. The significant parts are the base 8, the latch 4, the sliding button 2, the locking tongue 5, the ejector spring 7, the spring 6 for the sliding button 2, and the crossbar 3 forming the abutment part mentioned at the beginning. The latch indicated generally with 4 exhibits a long lever 9 with the supporting end 10 in front (touching the locking tongue 5), and in the back at the opposite end a bent-up short lever arm 14, with an opening 15. From the central field of the long lever 9, two restraining arms 11 have been bent down. These engage with the opening 18 of the locking tongue 5. The pivot axis 13 of the latch 4 is formed by two wings 21 sideways protruding from the rear end of the latch 4, perpendicularly to the insertion direction of the locking tongue 5, which project from the middle part of the long lever 9, and are placed in the recess 16 of the base.

The crossbar 3 can move in the insertion direction of the locking tongue in the recesses 22 in the side cheeks 23 of the base 8, and it moves together with the sliding button 2. This contains recesses at location 24, which contain the crossbar 3 on both surfaces in the direction of movement with little play. In the direction of movement, from the sliding button 2 a shaft 17 protrudes backwards, on which the spring 6 and the sliding button 2 are arranged. Thus, this spring is resting on the back wall of the sliding button at one end, and on the edge of the opening 15 of the latch 4 at the other end.

When the parts shown in FIG. 2 are assembled into the first execution of the locking buckle, the buckle works in the following manner: If the restrained passenger wishes to leave the vehicle, to release himself, or to remove the locking tongue 5 from the buckle, then in order to open the lock he must move the sliding button 2 to the right in the drawing, compressing spring 6, until the crossbar is not above surface 25 of the bent up supporting end 10, but to the right of it, according to FIG. 1. Through the compression of spring 6 and the pressure of ejector spring 7, latch 4 is now turned clockwise around the wings provided along pivot axis 13. This (supported with an eventual pull on the belt during pulling out the locking tongue 5) will exert a force on restraining arm 11 in such a manner, that this will act as a releasing hook. Together with the torque of the small lever arm 14, helped by the tensioned spring 6, and the force of ejector spring 7, the clockwise turning of latch 4 will not only withdraw the restraining arms 11 from the openings 18 of the locking tongue 5, but it will also insert the supporting end 10 with the now free upper surface 25 into the inner space of sliding button 2 open on the bottom. The locking buckle is thereby opened, and the user can pull out the locking tongue 5.

Fastening follows with reverse movement sequence: The locking tongue 5 inserted from left to right into the housing compresses the ejector spring 7 and it moves under the latch 4 in such a manner, that the restraining arms 11 again engage the openings 18 of the locking tongue 5. The locking is assured by the sliding button 2 moving to the left under the tension of spring 6 in such a way, that cross bar 3 is moved left into a position directly over surface 25 of the supporting end 10, which prevents the rotation of latch 4 in clockwise direction around pivot axis 13.

FIG. 3 is another execution of the invention, where the housing consists of a lower part 1' and an upper part 1''. The arrangement is the opposite of that in FIG. 2, i.e. the locking tongue 5 is shown on the right and can be pushed to the left into base 8 of the buckle to engage with latch 4 and compress ejector spring 7. The sliding button 2 has a somewhat different shape, but again it exhibits shaft 17 and spring 6. The sliding button 2 exhibits along its sides in the direction of motion two sidewalls 26, which protrude to the base 8 of the buckle. There is also an arm 27 attached to the sliding button on the back side, i.e. in FIG. 3 to the left, which improves the guidance of motion. It is not directly visible from FIG. 3, but it is obvious from the description, that sliding button 2 again has on its bottom surface a corresponding recess to accept the top surface 25 of the bent up supporting end 10 of the latch 4, and a recess to accept the crossbar 3. This recess on the sliding button 2 of FIG. 3 is larger than that on FIG. 2, so that the crossbar 3 can move in this recess (not shown) back and forth, relative to the sliding button. More accurately, this recess (in the absence of two holes to restrain the crossbar on both sides of sliding button 2) has a front surface, against which the crossbar is supported by the expansive force of a supporting spring 28 or 28'.

Since the supporting spring 28 or 28' is arranged in FIG. 3 on the left of crossbar 3, it tries to push crossbar 3 to the right, i.e. the contact surface of the recess is right on the front side of the buckle towards the locking tongue. The supporting spring can have the shape of spring 28, or it can be a torsion spring, as in 28'. It is understood, that these are two executions, and only one of these supporting springs is included in the buckle.

As mentioned above, the recess in which crossbar 3 is located, is formed so large in lengthwise direction of the belt buckle (i.e. in the insertion direction of the locking tongue), that when sliding button 2 is activated to disengage the buckle, i.e. when it is moved from right to left on FIG. 3, it forcibly takes the crossbar with it, due to its position on the surface of the recess. When sliding button 2 is released, and returns to the right due to the expansion force of spring 6, the crossbar can slide in this recess not shown and it could first remain at rest, if supporting spring 28 or 28' did not move it to the right. In other words, supporting spring 28 or 28' assures that after release of sliding button 2 the crossbar 3 will return to above surface 25 of the bent up supporting end 10 of latch 4, assuring a locked position of latch 4 with a released sliding button.

As opposed to the execution of FIG. 2, the locking tongue 5 of FIG. 3 shows a single opening 18 arranged in its middle. Correspondingly, on the middle part of latch 4 only one wing is stamped out, and bent out to form restraining arm 11.

Latch 4 also exhibits two ejector arms 12 arranged on the two sides, which are formed by two bent wings protruding from latch 4. Behind these to the left, at pivot axis 13, sideways protruding wings 21 form the turning shaft, as in the execution in FIG. 2. Opening 15 in the short lever arm 14 is open to the top. This has no significance, since spring 6 is guided and kept on sliding button 2 by shaft 17.

While base 8 is essentially the same construction in FIG. 3 as in FIG. 2, in FIG. 3 at the front of the ejector spring 7 a supporting part 29 is provided, which is made for example, of plastic. The front surface 30 of supporting part 29 engages in a closed buckle, the front surface of the locking tongue 5, while the back shoulders 32 of supporting part 29 are in contact with the ejector arms 12 of the latch 4.

The function of the locking buckle of FIG. 3 during insertion and locking of locking tongue 5, or during opening in the lock, is the same as in the execution shown in FIG. 2.

Instead of the forming of the restraining arm 11 (FIG. 2) or the two restraining arms 11 (FIG. 3), which are stamped and bent out of the center part of the latch 4, a restraining arm can be stamped out from the edge on each side (not shown in the Figures) in such a manner, so that they are bent under similarly to the execution in FIG. 2, thus bent out of latch 4, so that they are found at the two edges in a manner not shown. This has manufacturing advantages, especially with respect to simpler stamping and forming of the latch.

For additional strength purposes, base 8 of the buckle can be provided with an opening or openings (not shown) in the area directly beneath opening(s) 18 of tongue 5 when tongue 5 is in its locked position, and restraining arm(s) 11 is extended in length, such that in the locked position the restraining arm(s) 11 extend through opening(s) 18 as well as the opening(s) in base 8.

It is to be understood that variations and modifications of the present invention may be made without departing from the scope of the invention. It is also to be understood that the scope of the invention is not to be interpreted as limited to the specific embodiment disclosed herein, but only in accordance with the appended claims when read in light of the foregoing disclosure.

We claim:

1. Buckle, particularly for safety belts in automotive vehicles, comprising a casing attached by means of a fastening arrangement to an anchoring point on the vehicle, a latch that can be brought into locking engagement with an opening in a tongue, an ejector spring for the tongue and a bias spring for a push button that can be brought into engagement with the latch, characterized by the fact that the latch (4) can pivot on a pivotal axis (13) which is approximately perpendicular to the direction of insertion of the tongue (5) and is fixed in the casing (1), said latch having a generally T-shape with integral ears provided at the top of said T, said ears providing said pivotal axis of said latch, said latch being biased in the unlocked position by the pressure exerted by the bias spring (6), and when said bias spring (6) is at least partially extended, said latch is kept in locking engagement with the tongue (5) by a reinforcing member (3) that moves together with the push button (2).

2. Buckle as claimed in claim 1, characterized by the fact that the supporting end (10) of the latch (4), which is disposed near the reinforcing member (3), is located on the inside of the push button (2) and moves into a downwardly open internal cavity when the push button (2) is depressed.

3. Buckle as claimed in claim 2, characterized by the fact that the reinforcing member is shaped in the form of a crossbar (3) fastened to the underside of the push button (2), the longitudinal direction of said crossbar being parallel to the pivotal axis (13) of the latch (4).

4. Buckle as claimed in claim 3, characterized by the fact that the other end (14) of the latch (4) which is opposite the supporting end (10) is provided with an opening (15) to accommodate a guide pin (17) for the push button (2), said pin guiding the bias spring (6) and the push button (2), and said spring abutting on the other end (14) of the latch (4).

5. Buckle as claimed in claim 4, characterized by the fact that the pivotal axis (13) of the latch (4) is disposed near the other end (14) of said latch containing the opening (15) thereby forming a long and a short lever arm (9, 14).

6. Buckle as claimed in claim 5, characterized by the fact that the latch (4) is elongated, that it extends over about one-half to three-quarters of the length of the buckle casing (1) and that, when viewed in longitudinal section, it is shaped in the form of a rocker with U-shaped, upturned ends (10, 14).

7. Buckle as claimed in claim 6, characterized by the fact that a holding arm (11) protrudes from the underside of the latch (4) for a distance equal to the thickness of the tongue (5), at a point such that, in the locked position, said holding arm (11) lies in the opening (18) of the tongue (5).

8. Buckle as claimed in claim 1, characterized by the fact that the reinforcing member is a crossbar (3) guided at least on one side in the lower part of the button (2) whereby the length-wise direction of the crossbar (3) is parallel to the pivot axis (13) of the latch (4).

9. Buckle as claimed in claim 8, characterized by the fact that the crossbar (3) is abutting the front face of a recess in the button (2) and is under pretension of a support spring (28, 28').

10. Buckle as claimed in claim 1, characterized by the fact that the ejection spring (7) is mounted on a support member (29) at the side facing the tongue (5) and that the front surface (30) of the support member (29) being in contact with the tongue (5) and the rearward shoulders (32) being in contact with the ejection arm (12) of the latch (4).

11. Buckle as claimed in claim 1 wherein said ears are movable within recesses provided in said casing, whereby said pivotal axis is floating with respect to said casing.

12. Buckle as claimed in claim 1 including a spring biasing said reinforcing member forwards into a position at which it retains said latch in a locked position with respect to said opening in said tongue, said spring being supported by said casing.

13. A seal belt buckle comprising:

a housing;

a latch pivotably supported in said housing about a pivot axis, said latch being movable between lock and unlock positions, said latch including a latching surface adapted to engage with and restrain a tongue element in said housing when said latch is in its lock position, at least one contact surface on said latch, said contact surface being engaged following insertion of said tongue element into said housing a sufficient distance, engagement of said contact surface resulting in pivoting of said latch to its lock position, said contact surface being substantially spaced from said pivot axis;

a lock bar movable in said housing and adapted to retain said latch in its lock position; and release means for releasing said tongue element from said housing, actuation of said release means resulting in movement of said latch to its unlock position.

14. The buckle of claim 13 including an ejection bar slidably mounted in said housing and capable of moving said tongue element out of said housing, said ejection bar having a first surface engageable by said tongue element when said tongue element is inserted into said housing and a second surface engageable with said contact surface of said latch upon insertion of said tongue element into said housing, and spring means biasing said ejection bar to a forward position in said housing.

15. The buckle of claim 14 including two contact surfaces on said latch, said surfaces being engageable by said ejection bar.

16. The buckle of claim 15 wherein said pivot axis of said latch is provided by laterally spaced ears integral with said latch.

* * * * *